US007159263B2

(12) United States Patent
Sebor

(10) Patent No.: US 7,159,263 B2
(45) **Date of Patent: *Jan. 9, 2007**

(54) FLEXIBLE PLATE FOR SWIMMING POOL SUCTION CLEANER

(76) Inventor: Pavel Sebor, 751 Cricklewood Ter., Heathrow, FL (US) 32746

( * ) Notice: Subject to any disclaimer, the term of this patent is extended or adjusted under 35 U.S.C. 154(b) by 0 days.

This patent is subject to a terminal disclaimer.

(21) Appl. No.: 11/219,485

(22) Filed: Sep. 2, 2005

(65) Prior Publication Data

US 2005/0283935 A1 Dec. 29, 2005

Related U.S. Application Data

(63) Continuation of application No. 10/621,070, filed on Jul. 16, 2003, now Pat. No. 6,966,092.

(60) Provisional application No. 60/396,208, filed on Jul. 16, 2002.

(51) Int. Cl.
*E04H 4/16* (2006.01)

(52) U.S. Cl. ..... 15/1.7; 137/494

(58) Field of Classification Search ..... 15/1.7; 137/494

See application file for complete search history.

(56) References Cited

U.S. PATENT DOCUMENTS

| | | | | |
|---|---|---|---|---|
| 3,481,250 | A | 12/1969 | Toby | |
| 4,023,227 | A | 5/1977 | Chauvier | |
| 4,133,068 | A | 1/1979 | Hofmann | |
| 4,193,156 | A | 3/1980 | Chauvier | |
| 4,208,752 | A | 6/1980 | Hofmann | |
| 4,351,077 | A | 9/1982 | Hofmann | |
| 4,463,468 | A | 8/1984 | Chauvier | |
| 4,530,125 | A | 7/1985 | Hofmann | |
| 5,341,847 | A | 8/1994 | Rissik et al. | |
| 5,398,362 | A | 3/1995 | Chauvier | |
| 5,404,607 | A | 4/1995 | Sebor | |
| 5,418,994 | A | 5/1995 | Rissik et al. | |
| 5,421,054 | A | 6/1995 | Dawson et al. | |
| 5,465,443 | A | 11/1995 | Rice et al. | |
| 5,617,606 | A * | 4/1997 | Scott et al. | 15/246 |
| 5,706,540 | A | 1/1998 | Niewiarowski | |
| 5,794,293 | A | 8/1998 | Hoffinger | |
| 5,797,156 | A | 8/1998 | Sebor | |
| 5,970,557 | A | 10/1999 | Supra | |
| 6,112,354 | A | 9/2000 | Stoltz et al. | |
| 6,119,293 | A | 9/2000 | Phillipson et al. | |
| 6,122,794 | A | 9/2000 | Atkins | |
| D436,700 | S | 1/2001 | Forbes et al. | |
| 6,226,826 | B1 * | 5/2001 | Rice et al. | 15/1.7 |
| 6,237,175 | B1 | 5/2001 | Phillipson et al. | |
| 6,298,513 | B1 | 10/2001 | Rief et al. | |
| 6,311,353 | B1 | 11/2001 | Phillipson et al. | |

(Continued)

*Primary Examiner*—Randall Chin
(74) *Attorney, Agent, or Firm*—Allen, Dyer, Doppelt, Milbrath & Gilchrist, P.A.

(57) ABSTRACT

A submersible cleaner includes a valve within a flow passage for interrupting fluid flow and thus drive the cleaned over submerged surfaces to be cleaned. A retractable element moveable between the valve and a wall within the passage reduces a gap formed between them such that flow through the passage is directed along one side of the valve resulting in improved driving power and reduced clogging by debris passing through the passage. The retractable element may be attached to either the valve or the wall, and may make slidable engagement with between them. A flexible plate engaging the surface includes a plurality of tongues radially extending about the periphery with each tongue having a lower surface portion contacting the surface to be cleaned and an outmost portion contoured away from the surface.

18 Claims, 15 Drawing Sheets

U.S. PATENT DOCUMENTS 6,463,614 B1 * 10/2002 Supra ..... 15/1.7
2002/0002750 A1 1/2002 Phillipson et al.
2002/0116772 A1 8/2002 Phillipson et al.
2002/0166185 A1 11/2002 Balint

* cited by examiner

FLEXIBLE PLATE FOR SWIMMING POOL SUCTION CLEANER

CROSS-REFERENCE TO RELATED APPLICATIONS

This application is a continuation of Utility application Ser. No. 10/621,070, filed Jul. 16, 2003 issuing as U.S. Pat. No. 6,966,092 for Swimming Pool Cleaning Apparatus, which claims priority to Provisional Application No. 60/396,208 for Swimming Pool Cleaning Apparatus and Method, filed Jul. 16, 2002, the disclosures of which are hereby incorporated by reference herein in their entireties all commonly owned.

FIELD OF THE INVENTION

The present invention generally relates to self propelled swimming pool cleaners for cleaning submerged surfaces, and more particularly to a swimming pool cleaning apparatus incorporating a flow control valve for establishing intermittent flow of a fluid through the cleaner for causing the cleaner to travel across the surface to be cleaned.

BACKGROUND OF THE INVENTION

Submersible pool cleaners employing oscillating valves within a housing and flexible discs engaging the surface to be cleaned are generally well known, as illustrated by way of example with reference to U.S. Pat. No. 4,023,227 to Chauvier and U.S. Pat. No. 4,351,077 to Hofmann. What is also generally known are the problems associated with debris clogging fluid flow passages, wearing cleaner components rendering the cleaner ineffective or unusable, and the difficulty for a consumer attempting to replace such worn components. Embodiments of the present invention herein described provide an efficiently run submersible cleaner which includes components that are easily replaceable by the consumer.

SUMMARY OF THE INVENTION

A submersible cleaner in keeping with the teachings of the present invention may include a housing moveable along a submerged surface to be cleaned through fluid flow past a valve operable for moving the cleaner. The housing may include a flow passage for a flow of fluid and debris from an inlet to an outlet with the fluid and debris constrained to flow through an opening defined within the passage. A wall may extend into the flow passage for defining the opening. A valve may be operable within the flow passage for interrupting fluid flow. A retractable element may be moveable between the valve and the wall for reducing a gap formed between them. The retractable element may be attached to either the valve or the wall, and may make slidable engagement.

A flexible plate may be carried proximate the inlet for engaging the surface to be cleaned. The flexible plate may be described to include an upper surface, an opposing lower surface for contacting the surface to be cleaned, and a periphery defined by a plurality of tongues radially extending about the periphery. Each of the plurality of tongues may include a lower surface portion for contacting the surface to be cleaned and a contouring portion in a spaced relation with the surface to be cleaned during operation of the apparatus, thus upwardly lifting an outer most periphery of the plate from the surface to be cleaned. A plurality of reinforcing elements may be integrally formed with the flexible plate for upwardly contouring the periphery from the surface to be cleaned. The reinforcing elements may include a rib that may be integrally formed with the upper surface of the flexible plate with the rib extending radially outward while confined within the periphery of the flexible plate. Alternatively, the reinforcing element may comprise a flange extending along the peripheral edge of the tongue, or yet other reinforcing styled elements.

BRIEF DESCRIPTION OF THE DRAWINGS

Embodiments of the invention are described by way of example with reference to the accompanying drawings in which.

DETAILED DESCRIPTION OF THE PREFERRED EMBODIMENTS

Embodiments of the present invention will now be described more fully with reference to the accompanying drawings. It will be understood by those skilled in the art that this invention may be embodied in many different forms and should not be construed as limited to the embodiments set forth herein. Rather, these embodiments are provided so that this disclosure will be thorough and complete, and will fully convey the scope of the invention to those skilled in the art. Like numerals refer to like elements.

Figure 1:
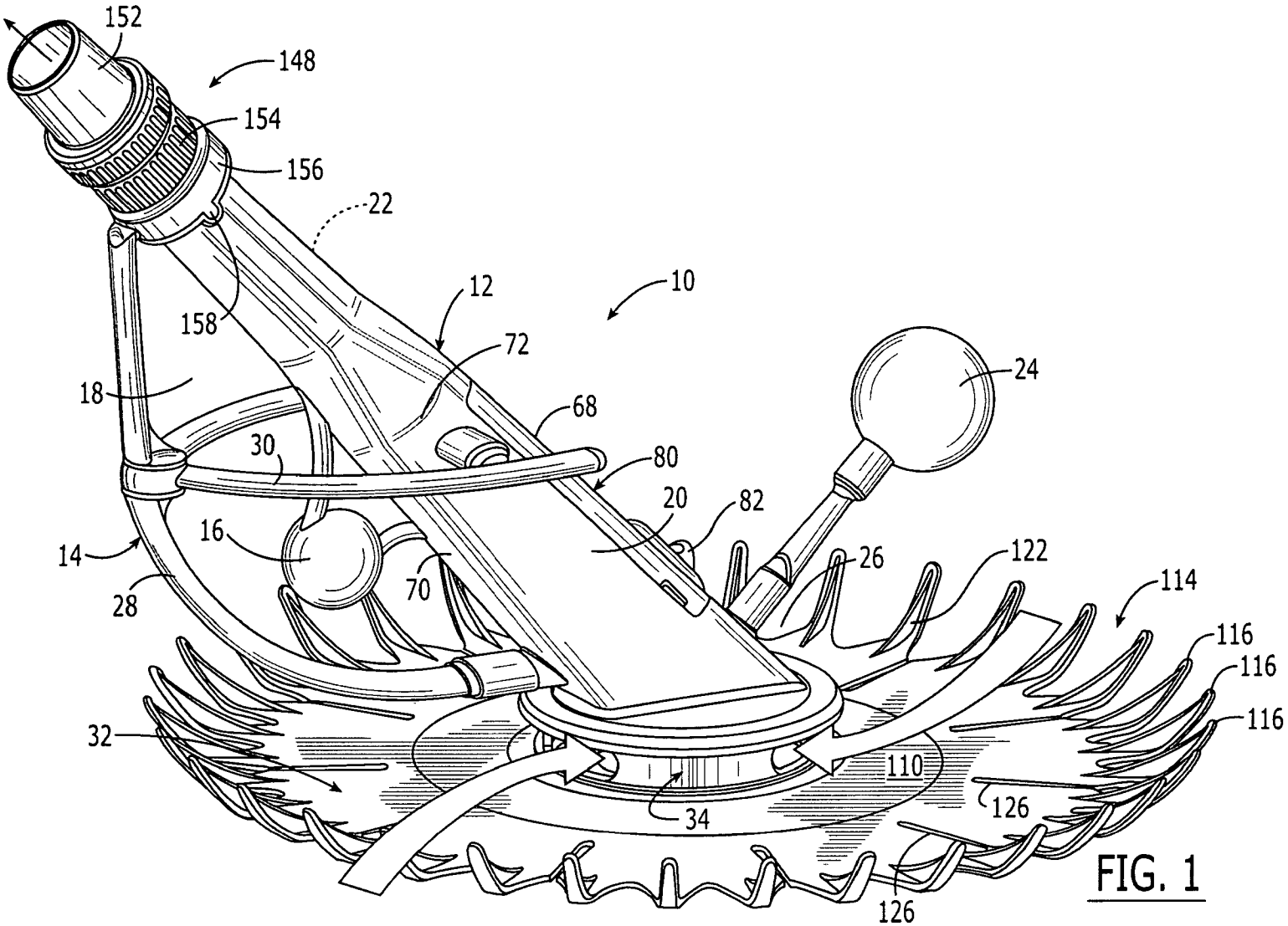
FIG. 1 is a left side perspective view of one embodiment of a swimming pool cleaner according to the present invention.
Figure 2:
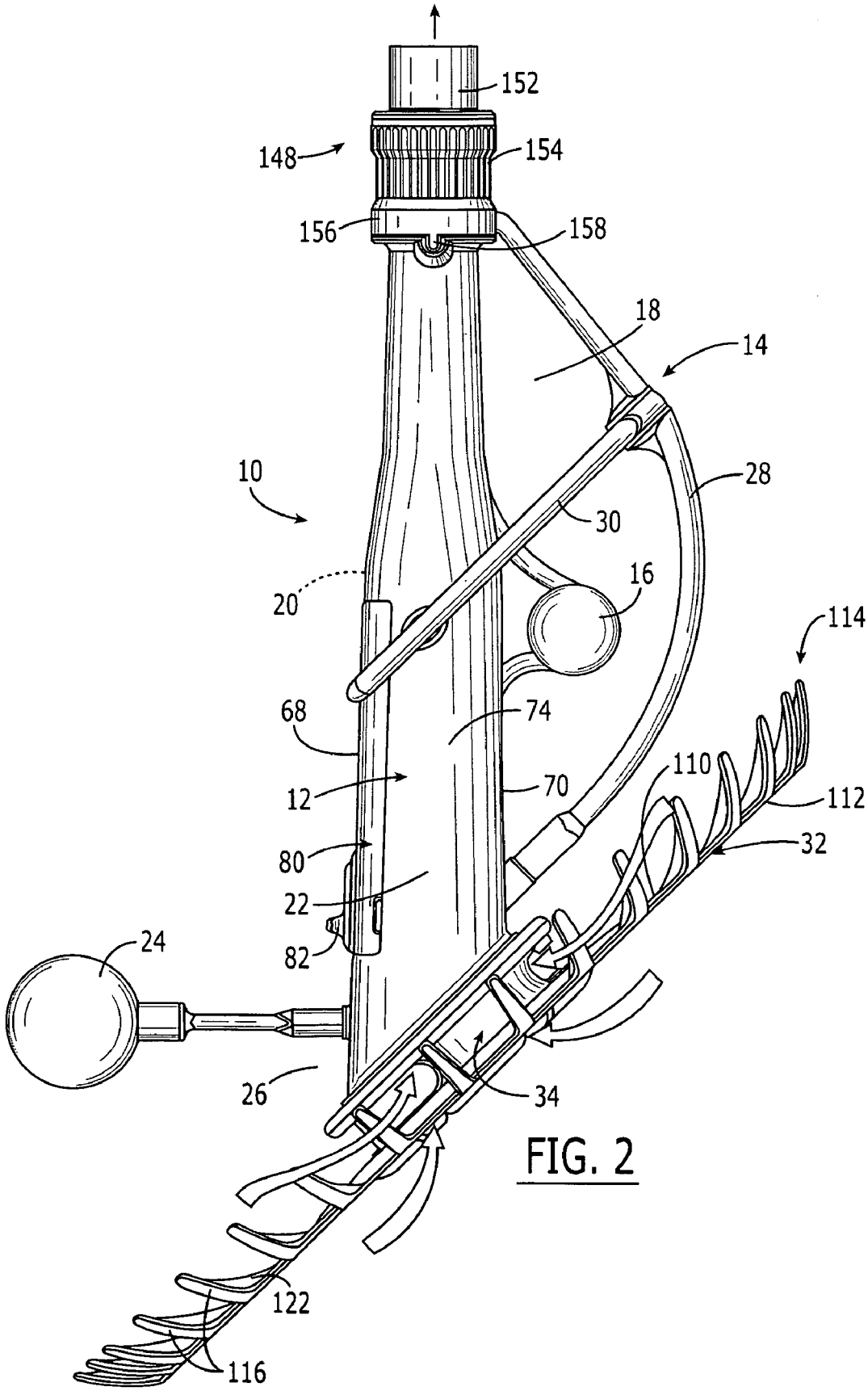
FIG. 2 is a right side elevation view of the cleaner of FIG. 1.

With reference initially to FIGS. 1 and 2, an embodiment of the present invention is herein described, by way of example, for a submersible swimming pool cleaner 10 having a housing 12 inclined toward a direction of travel, which housing carries a bumper 14 and weight 16 about a forward portion 18 with the bumper extending to left and right side portions 20, 22. A float 24 is carried at an aft portion 26 for acting in conjunction with the weight 16 in allowing the cleaner 10 to fall to an upright position when dropping from a sidewall of a swimming pool. Vertical and horizontal bumper members 28, 30 are effective in having the cleaner avoid obstructions within the swimming pool, such as steps and sharp corners. The housing 12 further carries a flexible plate 32 via attachment with a footpad 34.

The housing 12 includes a single flow passage 36 extending from an inlet 38 to an outlet 40 for a flow of fluid and debris through the passage, as described with reference to FIG. 3. A partition wall 42 extends into the single flow passage 36 such that the flow of fluid and debris (illustrated with arrows 44) are constrained to pass through an opening 46 formed thereby and pass to the outlet 40, which outlet is adapted for connection to a suction source 48. The flexible plate 32 is carried about the inlet 38 for engaging a submerged surface 50 to be cleaned. A valve 52 is pivotally carried within the flow passage 36 for interrupting fluid flow 44 through the passage during an oscillation of the valve between a seated position 54 for interrupting the flow to an unseated position 56 permitting the flow, as illustrated with reference to FIGS. 4 and 5. The valve 52 interrupts flow through the passage 36 resulting in a motion of the inclined housing 12 causing it to travel along the surface of the pool to be cleaned, the valve thus acting as the "motor" for the pool cleaner. With continued reference to FIG. 3, a suction of the fluid through the flow passage 36 causes an oscillating of the valve between the seated and the unseated positions and a resulting movement of the cleaner 10 across the submerged surface 50.

Figure 3:
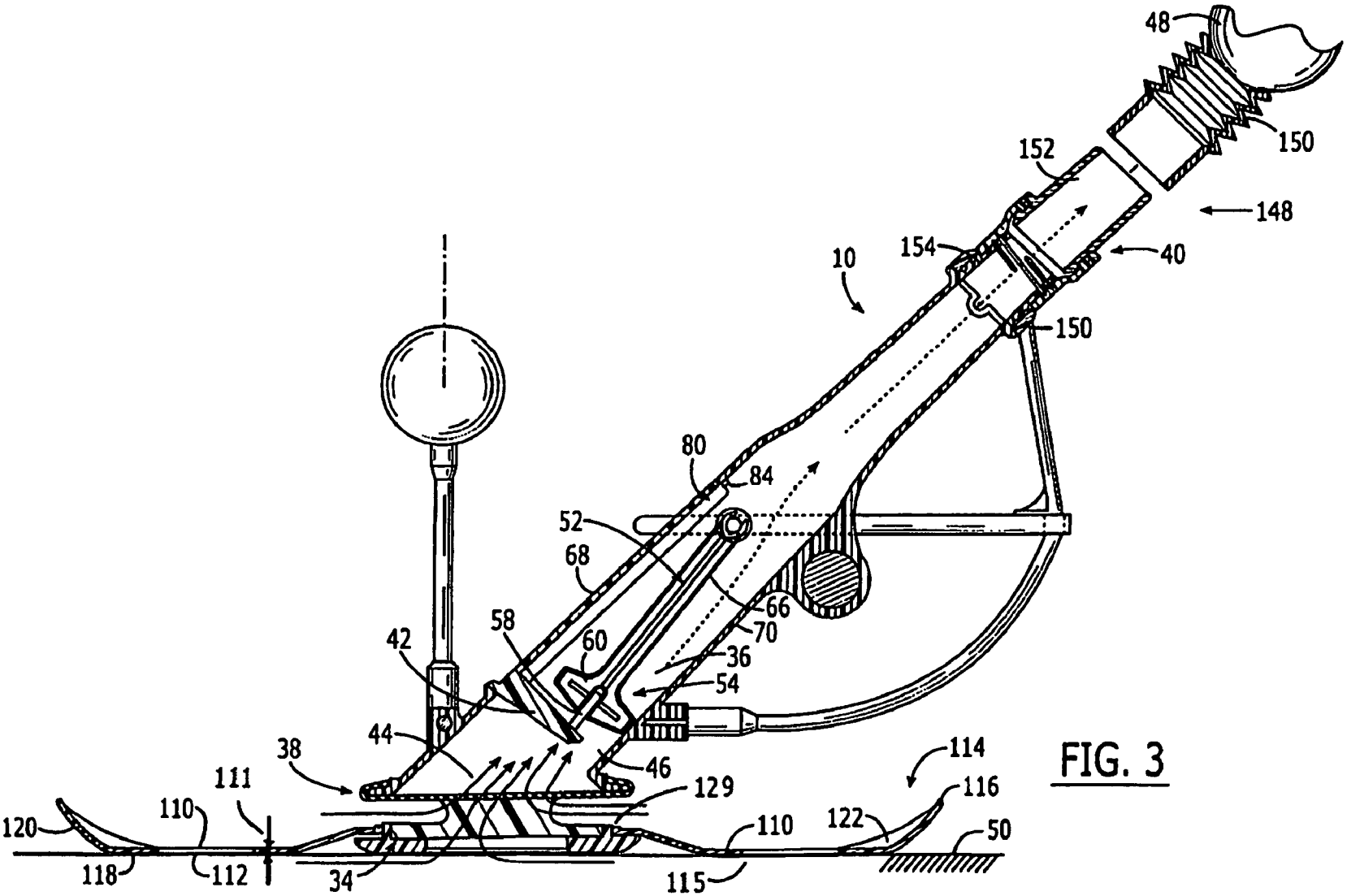
FIG. 3 is a partial cross section view of a pool cleaner illustrating fluid flow therethrough.
Figure 4:
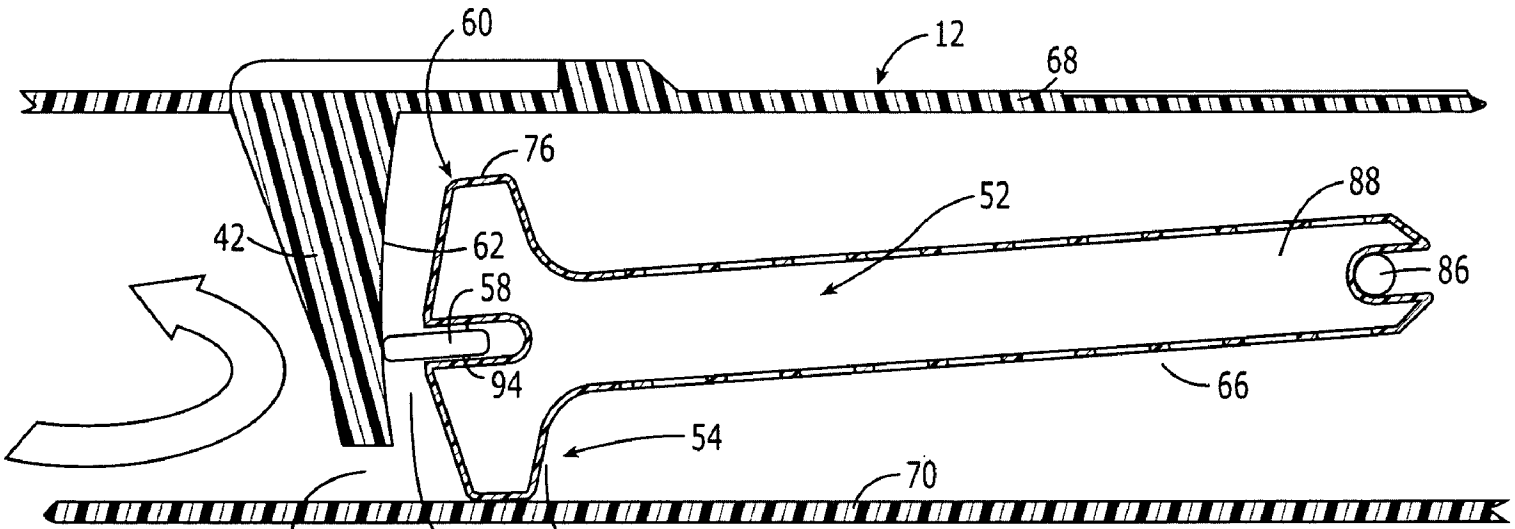
FIGS. 4 and 5 are partial cross section view of a housing portion of the embodiment of FIG. 3 illustrating an enlarged view of the oscillator valve in a seated position and an unseated position, respectively.
Figure 5:
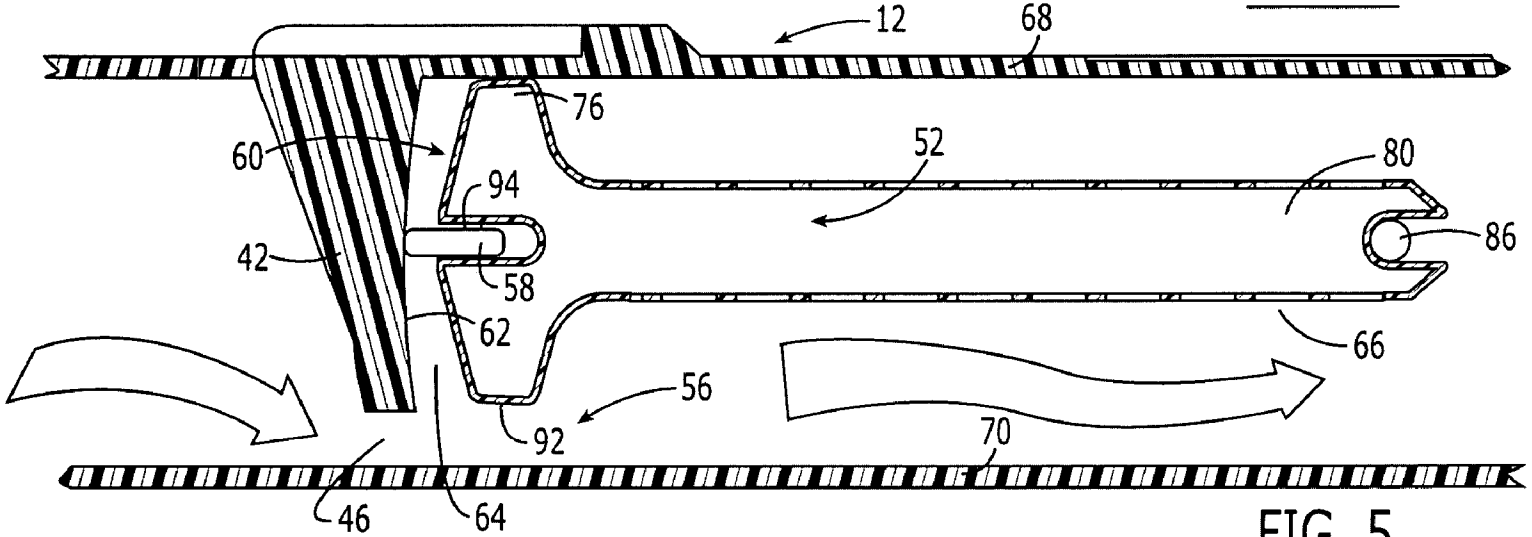
Figure 6:
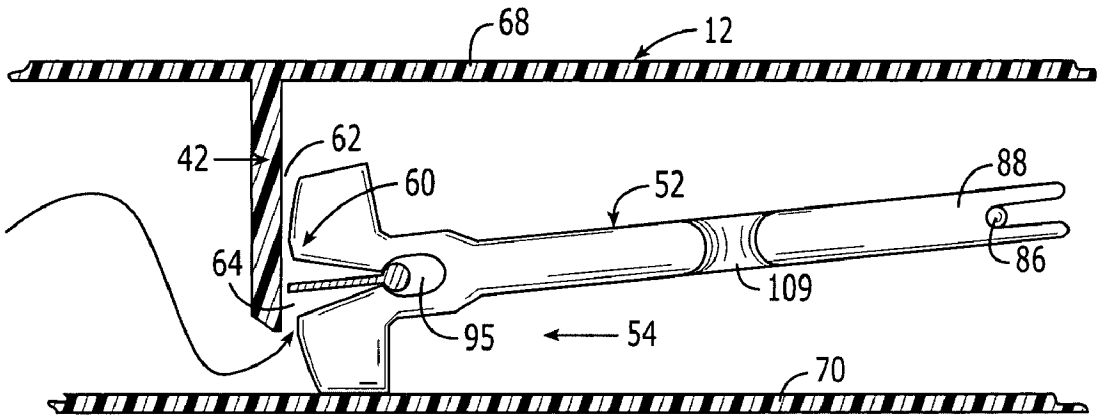
FIG. 6 is an alternate embodiment of the valve in keeping with the teachings of the present invention.

With continued reference to FIGS. 3–5, a retractable element 58 is moveable between a valve distal end 60 and a surface 62 of the partition wall 42 for reducing a gap 64 formed between them, thus substantially limiting the flow of the fluid and debris to only one side 66 of the valve 52. The retractable element 58 may be dimensioned such that the fluid flow through the passage 36 causes the retractable element to have slidably engagement between the valve distal end 60 and the surface 62 of the partition wall 42 during the oscillation of the valve, as illustrated with reference again to FIGS. 4 and 5, or alternatively may fully close or simply reduce the size of the gap 64, as illustrated with reference to FIG. 6.

With reference again to FIGS. 1–5, the single flow passage 36 may be defined by opposing top and bottom walls 68, 70 in combination with opposing left and right sidewalls 72, 74, wherein the distal end 60 of the valve 52 contacts the bottom wall 70 in the seated position 54 and oscillates between the seated position and a stop 76 formed with the distal end 60 for contacting the top wall 68.

Figure 7:
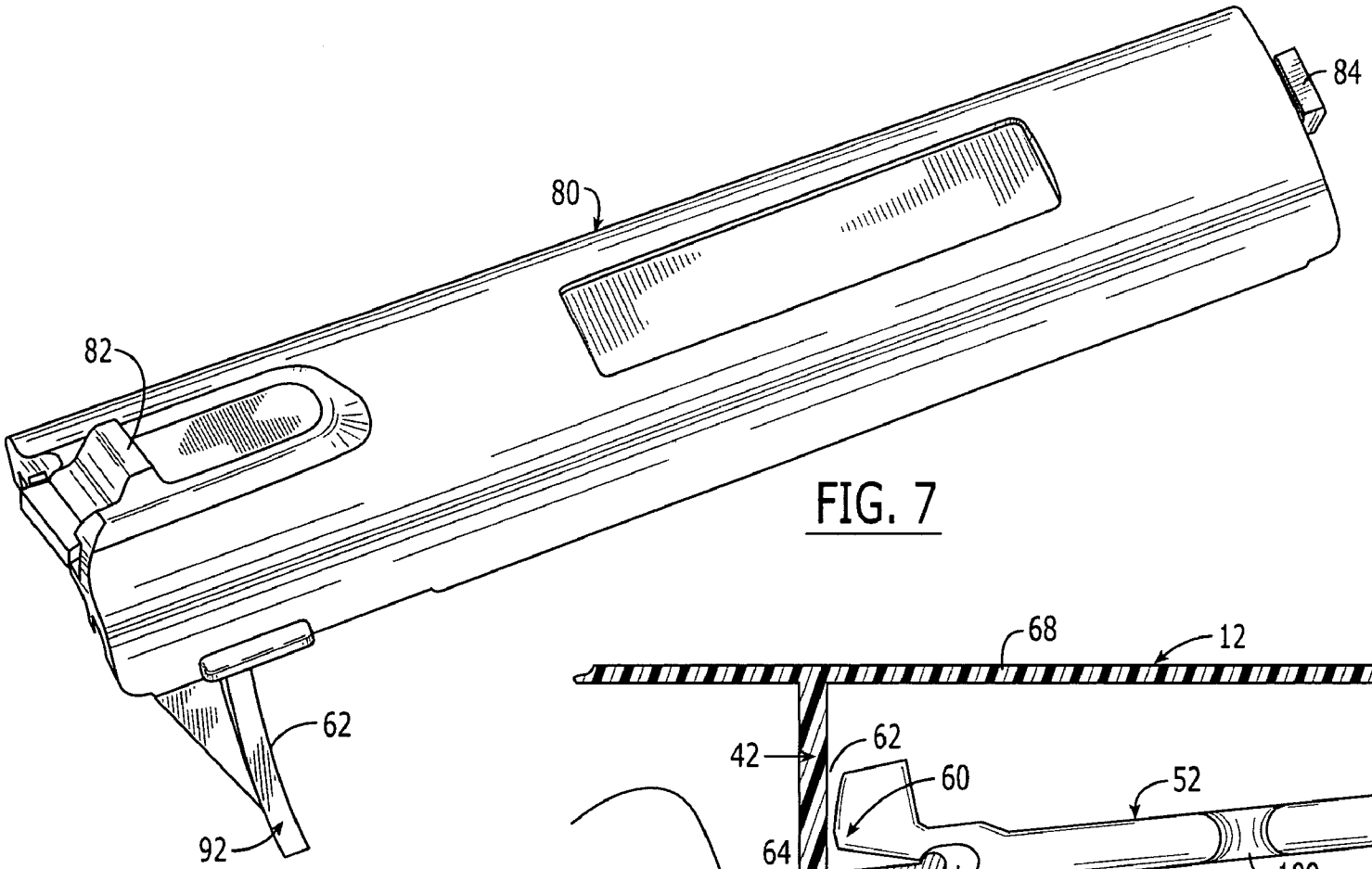
FIG. 7 is a perspective view of a cover.
Figure 8:
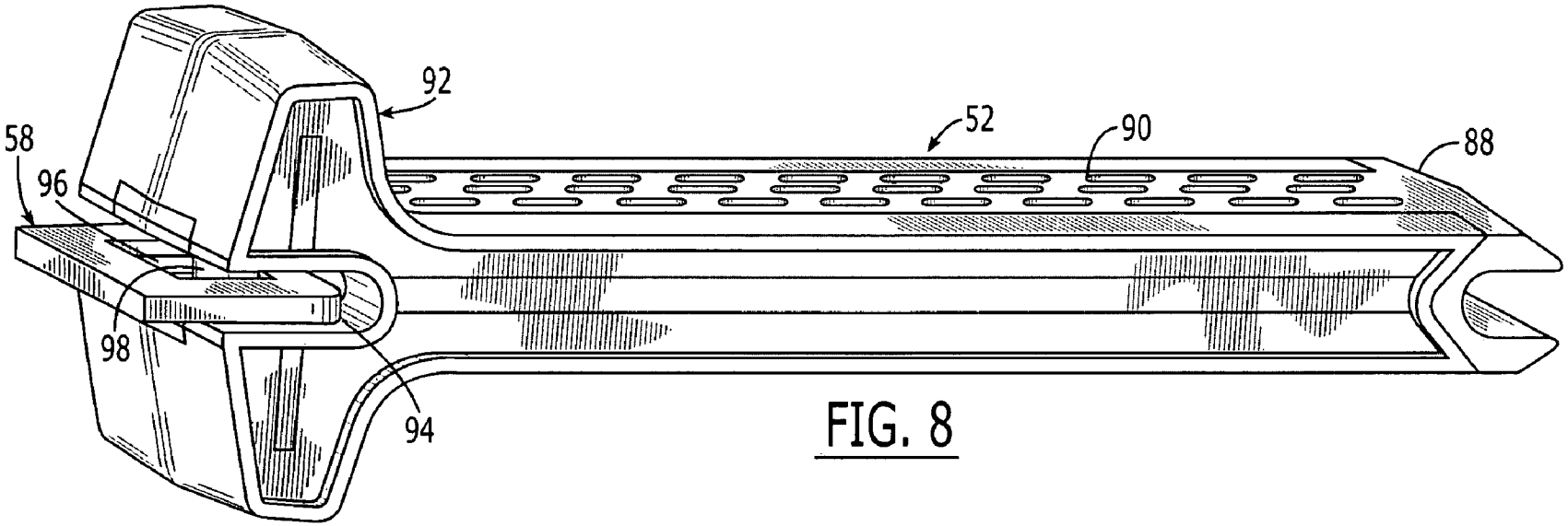
FIGS. 8 and 9 are perspective and side views of an embodiment of a valve.
Figure 9:
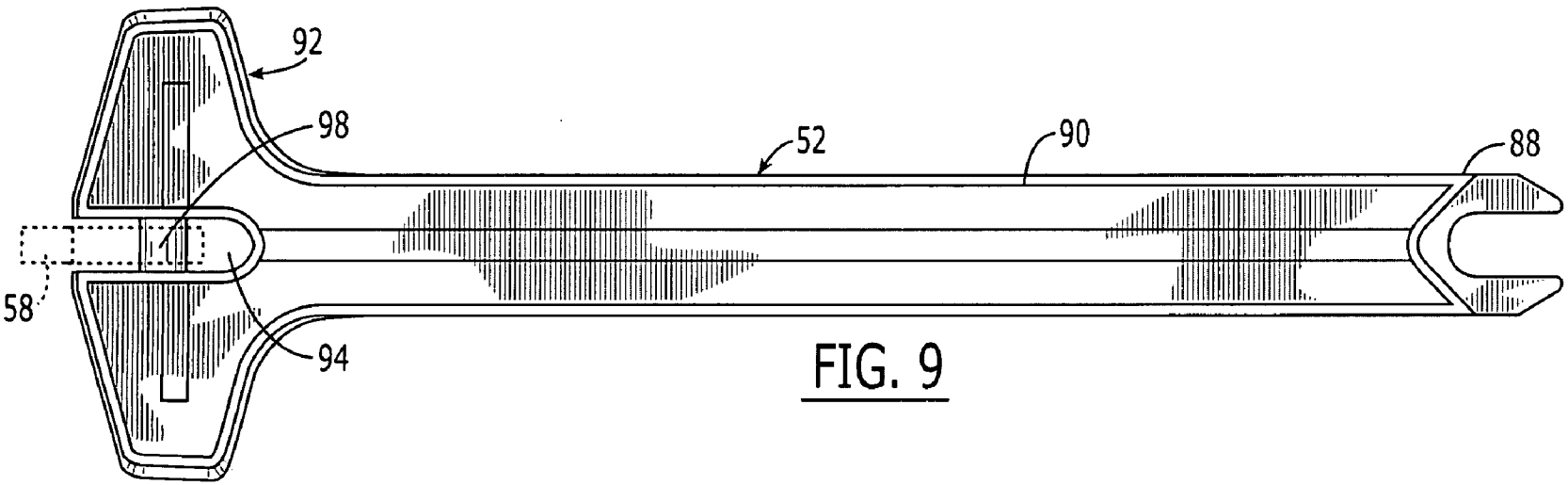
Figure 10:
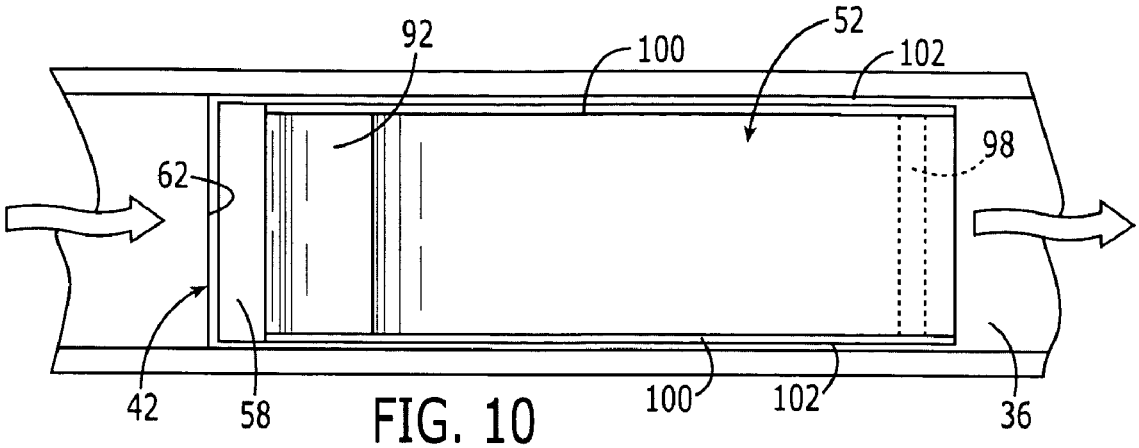
FIG. 10 is a partial top view looking down on the valve carried within the housing.

As illustrated with reference again to FIGS. 1–5, an access opening 78 within the top wall 68 provides entry into the housing 12 and the flow passage 36. A detachable cover 80 encloses the opening 78. Access to the flow passage provides a convenience when clearing out debris lodged therein or replacing the valve, by way of example. In one embodiment of the cleaner, as herein described by way of example, the partition wall 42 is integrally formed with the cover 80, as further illustrated with reference to FIG. 7. The cover 80 includes a lock 82 and tab 84 located at ends of the cover for securing the cover to the housing 12 for covering the opening 78. A pivot pin 86 is carried by the housing 12 for pivotal connection with a proximal end 88 of the valve 52. As illustrated with reference again top FIGS. 4 and 5, the valve 52 may be constructed to include an elongate arm 90 having the proximal end 88 for connection to the pivot pin 86. A head portion 92 is located at the valve distal end 60. The distal end 60 is carried within the passage 36 upstream the proximal end 88. In the embodiment illustrated with reference to FIGS. 4 and 5, by way of example, the head portion 92 includes a slot 94 for slidably receiving the retractable element 58. One embodiment of the retractable element 58 includes a slit 96 that is operable with a pin 98 carried within the slot 94, as illustrated with reference to FIGS. 8 and 9. Flexible side edges 100 extend along the longitudinal sides of the valve 52 for minimizing side gaps 102 on the sides of the valve and for providing a close fit, as further illustrated with reference to FIG. 10, thus enhancing control of the fluid flow along the one side 66 of the valve 52, as earlier described with reference to FIGS. 3–5.

Figure 11:
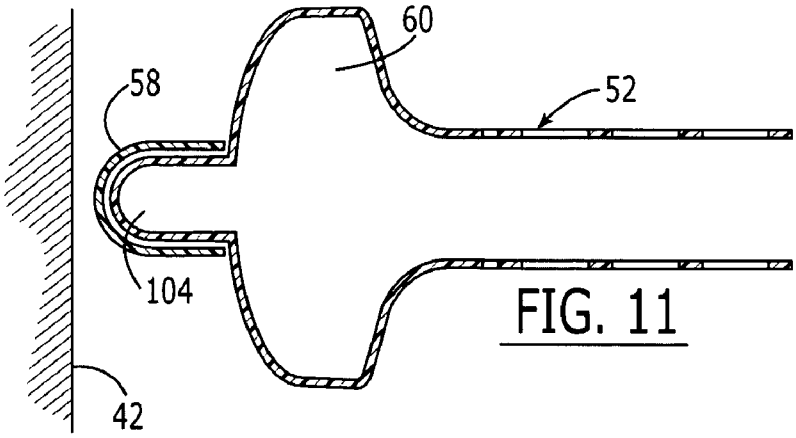
FIGS. 11, 11A, and 12 illustrate alternate embodiments of the invention having a retractable element carried by the valve as in FIG. 11 and alternatively by a partition wall as in FIGS. 11A and 12.
Figure 11A:
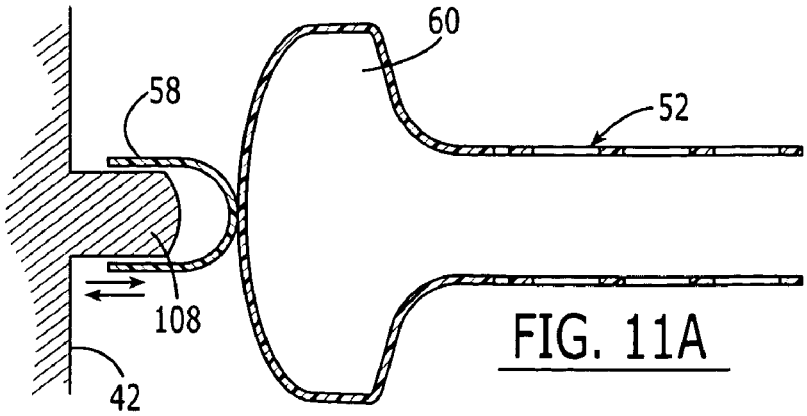
Figure 12:
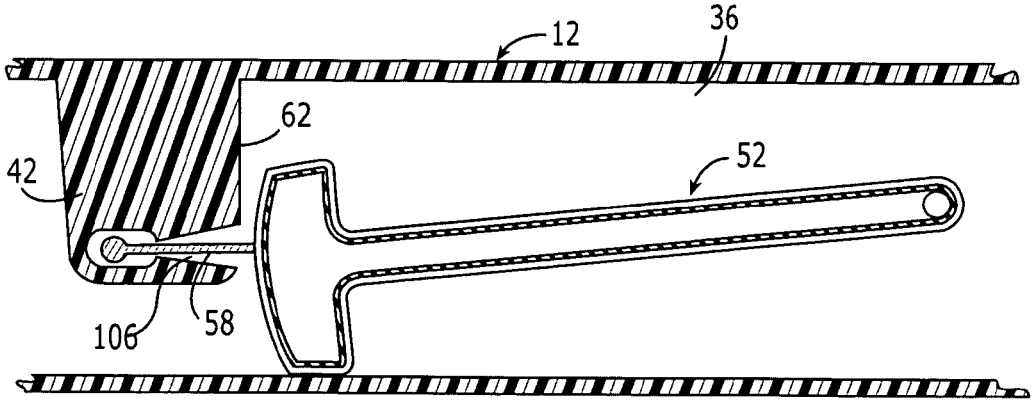
Figure 13:
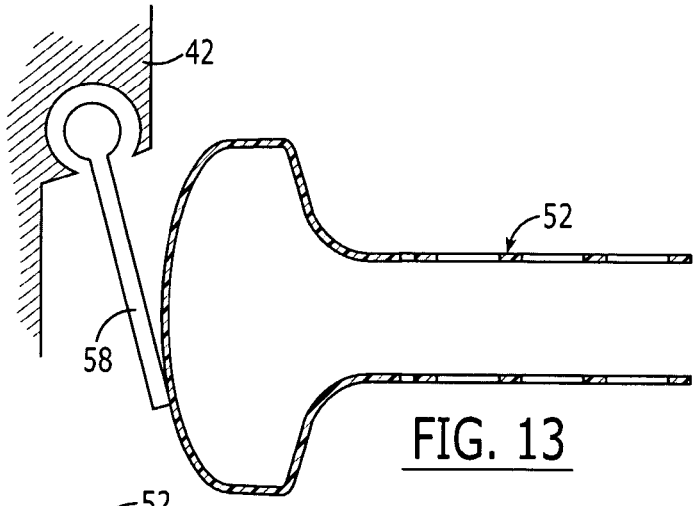
FIGS. 13–20 illustrate alternate embodiments of the valve operable with the retractable element.
Figure 14:
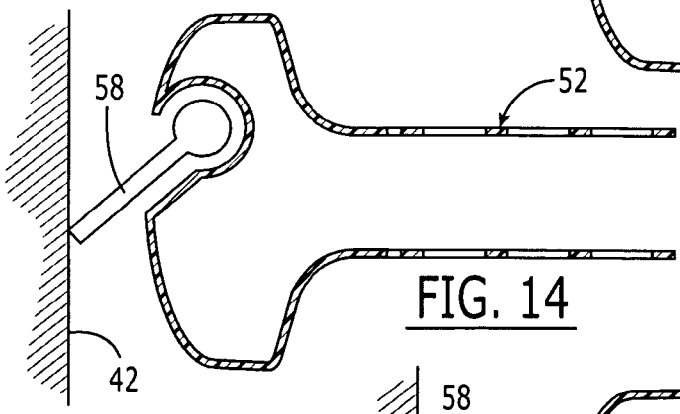
Figure 15:
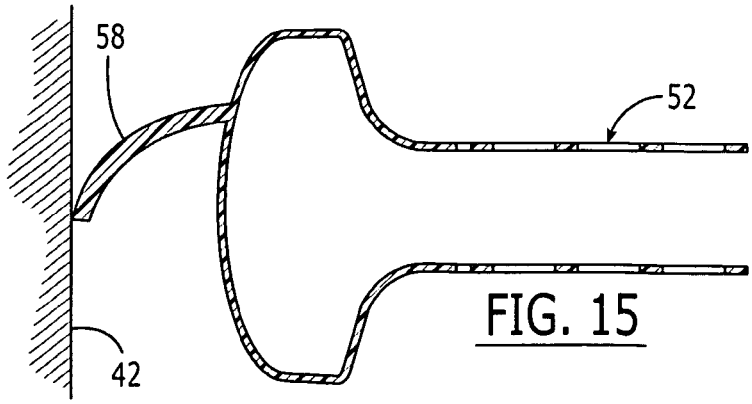
Figure 16:
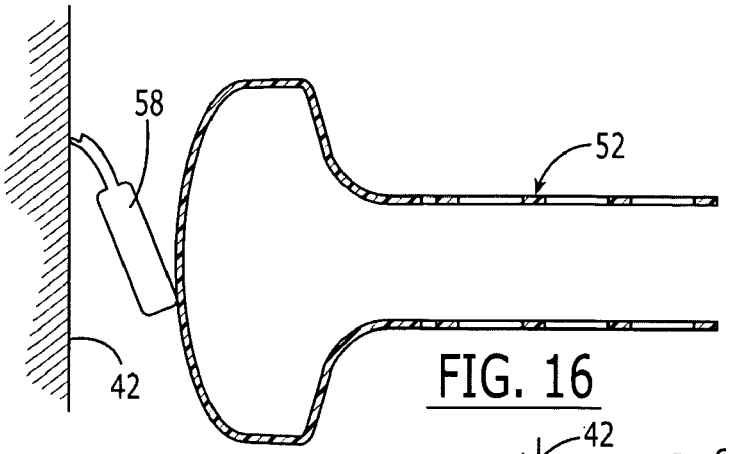
Figure 17:
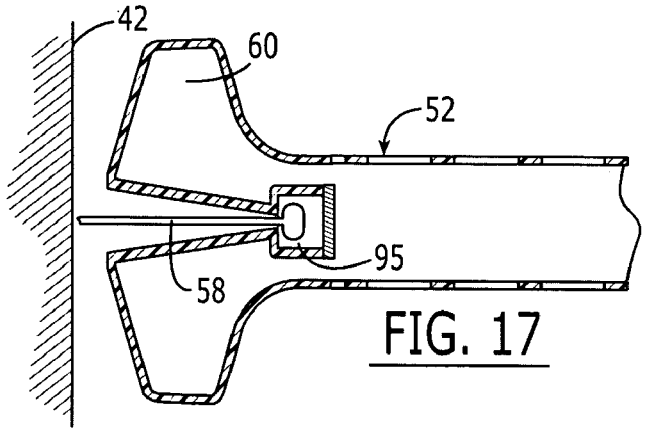
Figure 18:
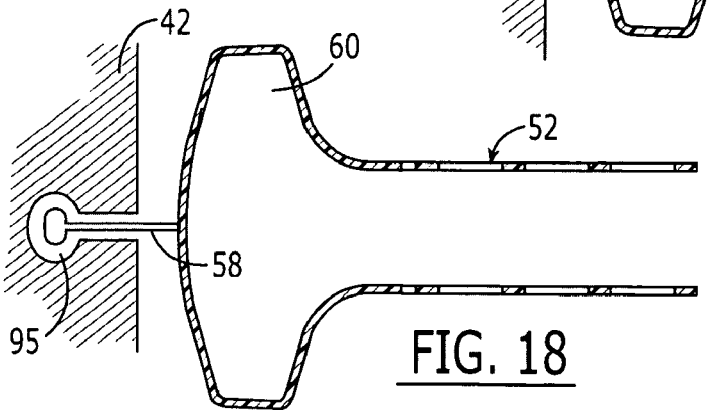

Alternate embodiments keeping within the teachings of the present invention, may include by way of example, the head portion 92 having a protrusion 104 extending radially outward from the valve distal end 60 for slidably receiving the retractable element 58, as illustrated with to reference to FIG. 11. Further, the partition wall 42 may include a slot 106 extending for slidably receiving the retractable element 58, as illustrated with reference to FIG. 12. Yet further, the partition wall 42 may include a protrusion 108 extending outward toward the valve 52 for slidably receiving the retractable element 58, as illustrated by way of further example with reference to FIG. 11A. As herein illustrated, the retractable element 58 may have various shapes and may be attached to the valve 52 or to the partition wall 42 without deviating from the teachings of the present invention, and may or may not fully close the gap 64, as illustrated with reference to FIGS. 13–20.

Figure 19:
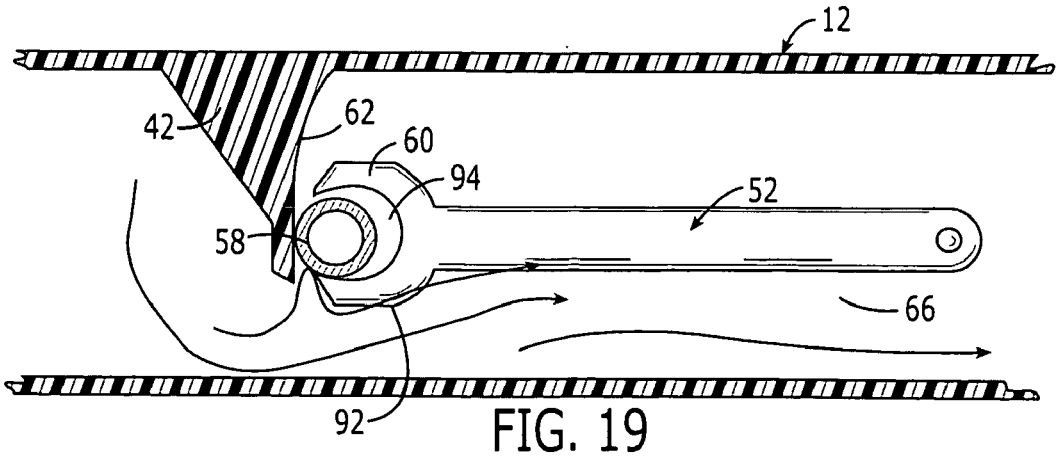
Figure 20:
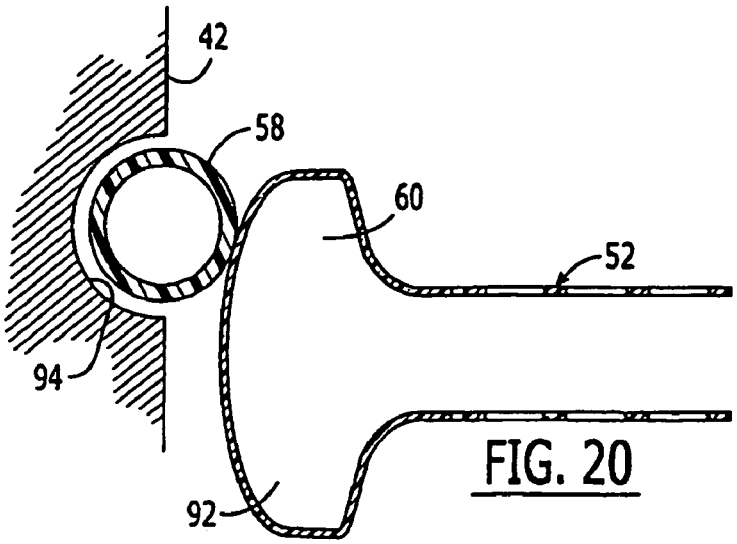

With reference to FIGS. 19 and 20, by way of example, the generally circular cross sectional shape of the retractable element 58 and carried within a generally arcuate shape for the slot 94 supports a rolling motion for the retractable element during movement of the head portion 92, thus reducing wear of the surface and element while remaining effective in directing fluid flow to the one side 66 of the valve 52. The retractable element 58 is movably carried within the slot 94 making continuous contact with the 62 of the partition wall 42 or in close proximity as herein described. With reference again to FIGS. 6, 12, and 17, an embodiment of the valve 52 includes the head portion 92 having an angled slot 94 tapering from outside toward a slotted hole 95, or alternatively having the tapered slot within the partition wall as illustrated with reference to FIG. 18. The head contact element includes an elongate portion having one end extending out of the slot 94 and an opposing end having a bulbous portion for a sliding movement within the hole 95. Such an embodiment allows the retractable element 58 to be secured within the slot 94 during installation and easily held therein during assembly of the valve. Further, a flexible arm portion 109 may be provided as a shock buffer that results in reducing noise generated by the oscillating valve 52, as illustrated with reference again to FIG. 6.

Figure 21:
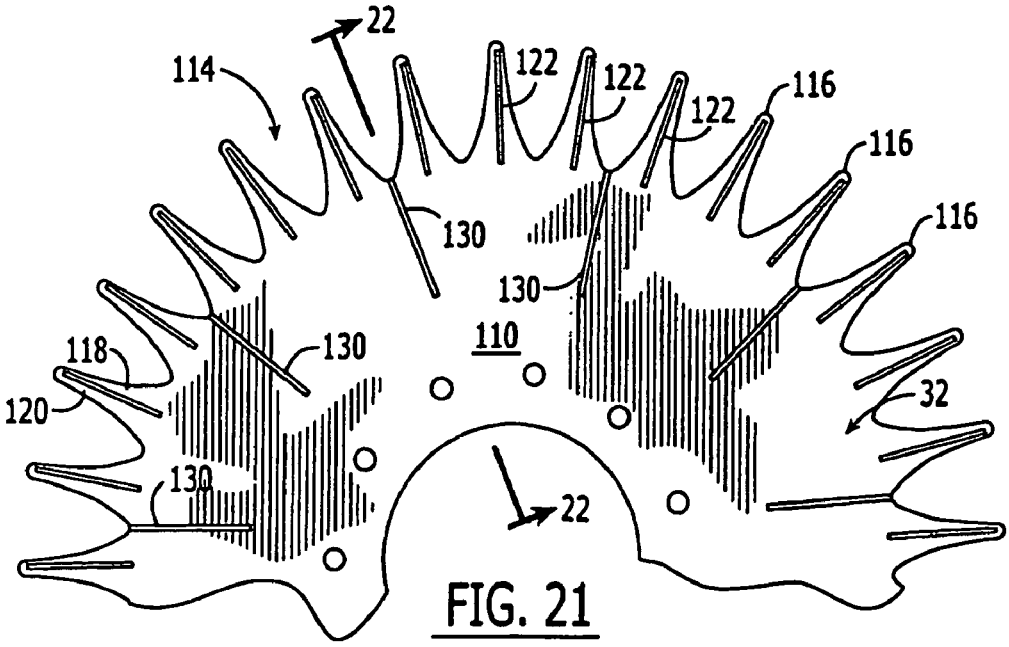
FIG. 21 is a partial top view of one embodiment of a flexible plate.
Figure 22:
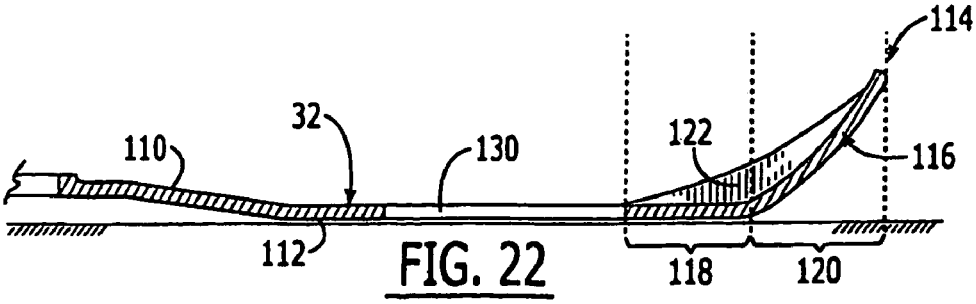
FIG. 22 is a partial cross section elevation view taken through lines 22—22 of FIG. 21.
Figure 23:
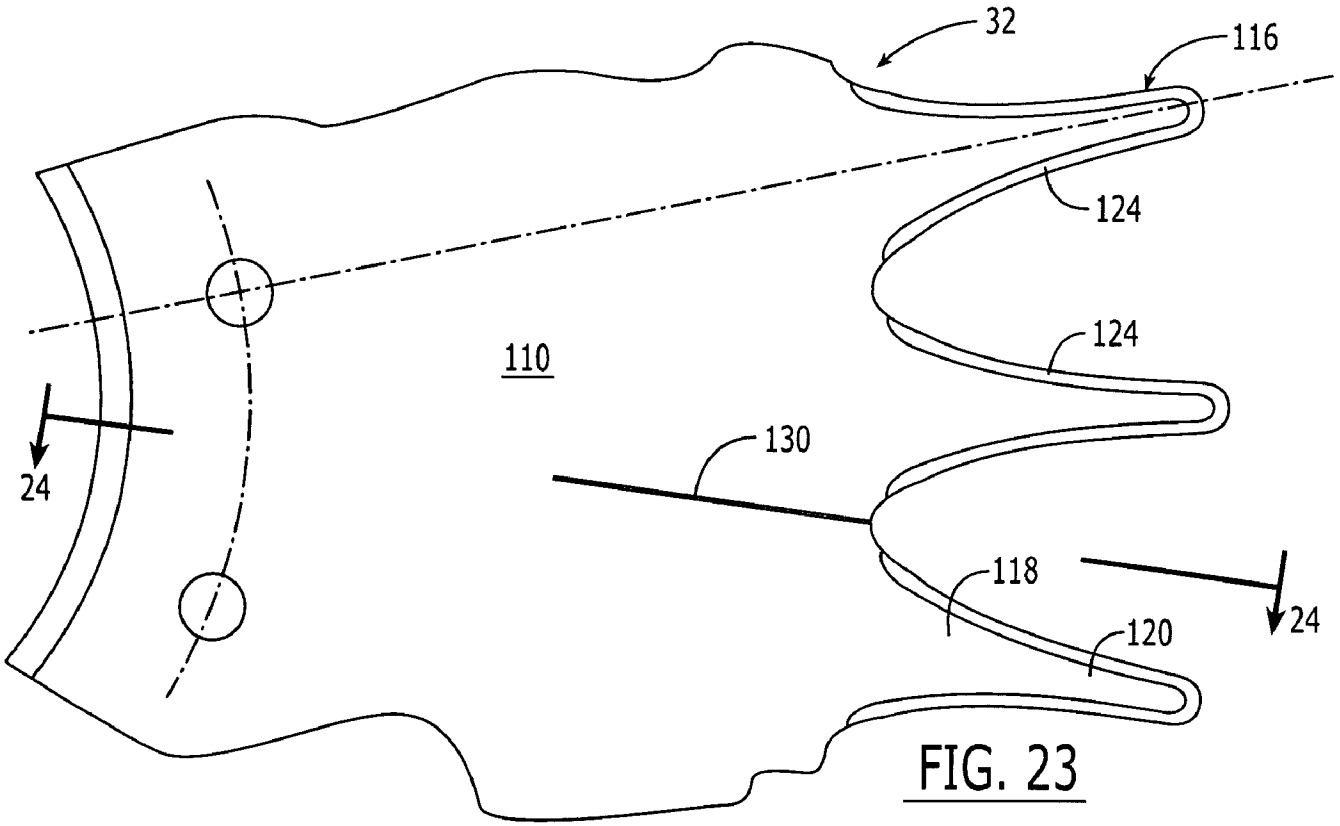
FIG. 23 is a partial top view of one embodiment of a flexible plate.
Figure 24:
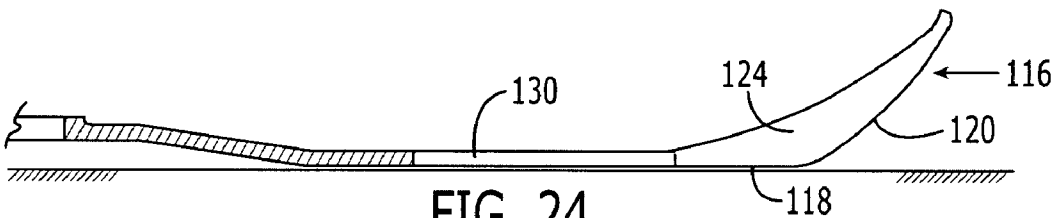
FIG. 24 is a partial cross section elevation view taken through lines 24—24 of FIG. 23.

With reference again to FIGS. 1–3, the flexible plate 32 may be described as having an upper surface 110 and an opposing lower surface 112 for contacting the surface to be cleaned 50, the upper and lower surfaces defining a thickness dimension 111. A periphery 114 of the plate 32 includes a plurality of tongues 116 radially extending thereabout. Each tongue 116 includes a lower surface portion 118 for contacting the surface to be cleaned 50 and a contoured portion 120 in a spaced relation with the surface to be cleaned during operation of the cleaner 10, as illustrated with reference again to FIG. 3, and to FIGS. 21 and 22, the outer most peripheral portion or periphery of the plate 32 being upwardly lifted from the surface to be cleaned. In one embodiment, as herein illustrated, a rib 122 is integrally formed with the upper surface 110 of the flexible plate 32 at the tongue 116. The rib 122 reinforces the tongue 116 for securing the contoured portion 120 in the convex shape. Alternate reinforcing element shapes may be formed with the flexible plate 32 for upwardly contouring the periphery 114 upwardly from the surface to be cleaned 50, including a flange 124 extending along a peripheral edge of the tongue, as illustrated by way of example with reference to FIGS. 23 and 24.

Figure 25:
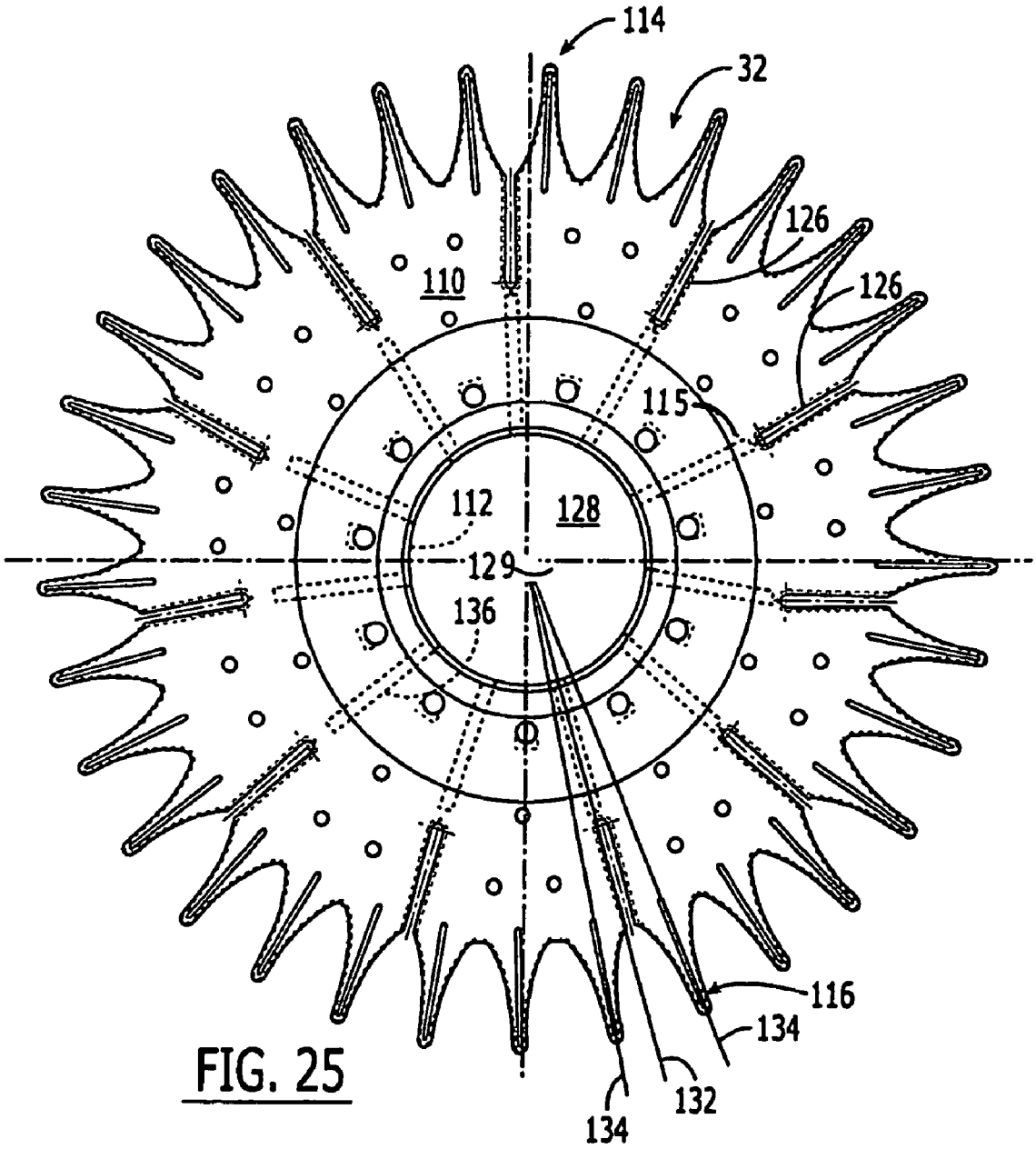
FIG. 25 is a top plan view of one embodiment of a flexible plate.

As illustrates with reference again to FIG. 2 and to FIG. 25, embodiments of the plate 32 may include slots 126 radially extending from the periphery 114 through an intermediate portion 115 within the plate 32 from a center portion 128 of the plate having an aperture 129 therein. As is well known to those skilled in the art, the center portion 128 generally includes the aperture 129 for connection of the plate 32 to the footpad 34, as illustrated with reference again to FIG. 3. The slot 126 herein described is tapered so as to provide a diminishing gap as the taper extends radially outward from the center portion 128. Alternatively, the plate 32 may include a slit 130, as illustrated with reference again to FIGS. 22 and 24. Yet further, a combination of tapered slot 126 and slit 130 may be formed within the plate 32, as illustrated with reference to FIG. 26, such slots and slits extending radially outward from the center portion 128 of the plate 32 provide added flexibility to the flexible plate 32 and improved maneuverability over contours within the surface to be cleaned 50. A plurality of slots or slits may be symmetrically located as herein illustrated or located as desired for surface conditions.

By way of further example, and as illustrated with reference again to FIG. 25, the plurality of slots may extend along a first imaginary line 132 centrally positioned between second imaginary lines 134 passing centrally through each of the plurality of tongues 116. Further, the plate 32 may include grooves 136 within the lower surface 112 and extending radially outward for the center portion 128. As illustrated, the grooves 136 may extend only partially between the center portion 128 and the periphery 114 of the plate 32.

Figure 29:
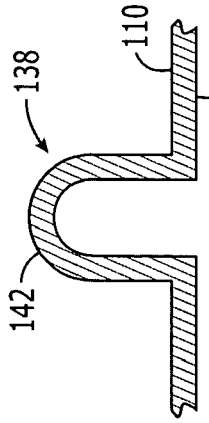
FIG. 29 is a partial cross section view taken through lines 29—29 of FIG. 27.
Figure 27:
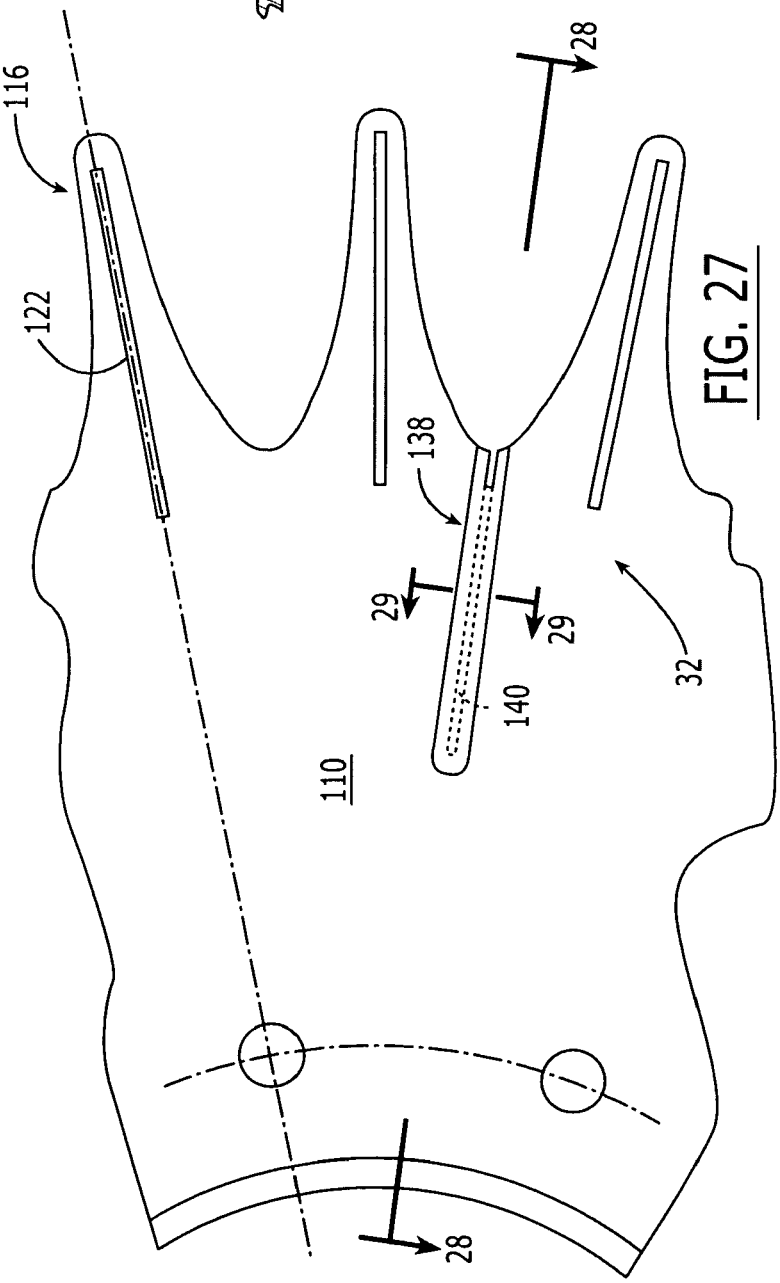
FIG. 27 is a partial top view of one embodiment of a flexible plate.
Figure 28:
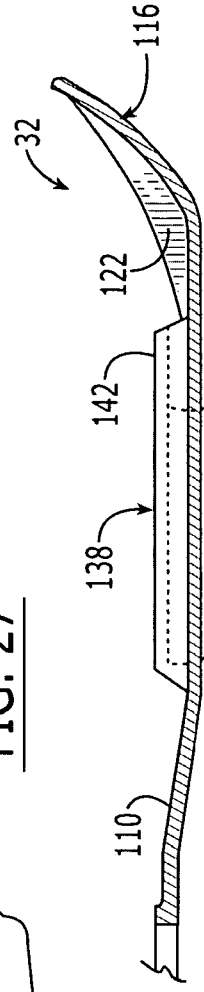
FIG. 28 is a partial cross section elevation view taken through lines 28—28 of FIG. 27.

Pleats 138 provide yet another alternative for adding flexibility to the plate 32, as illustrated with reference FIGS. 27–29. Each of a plurality of pleats 138 extending radially from the center portion 128 forms a groove 140 within the lower surface 112 and a protrusion 142 in the upper surface 110.

Figure 26:
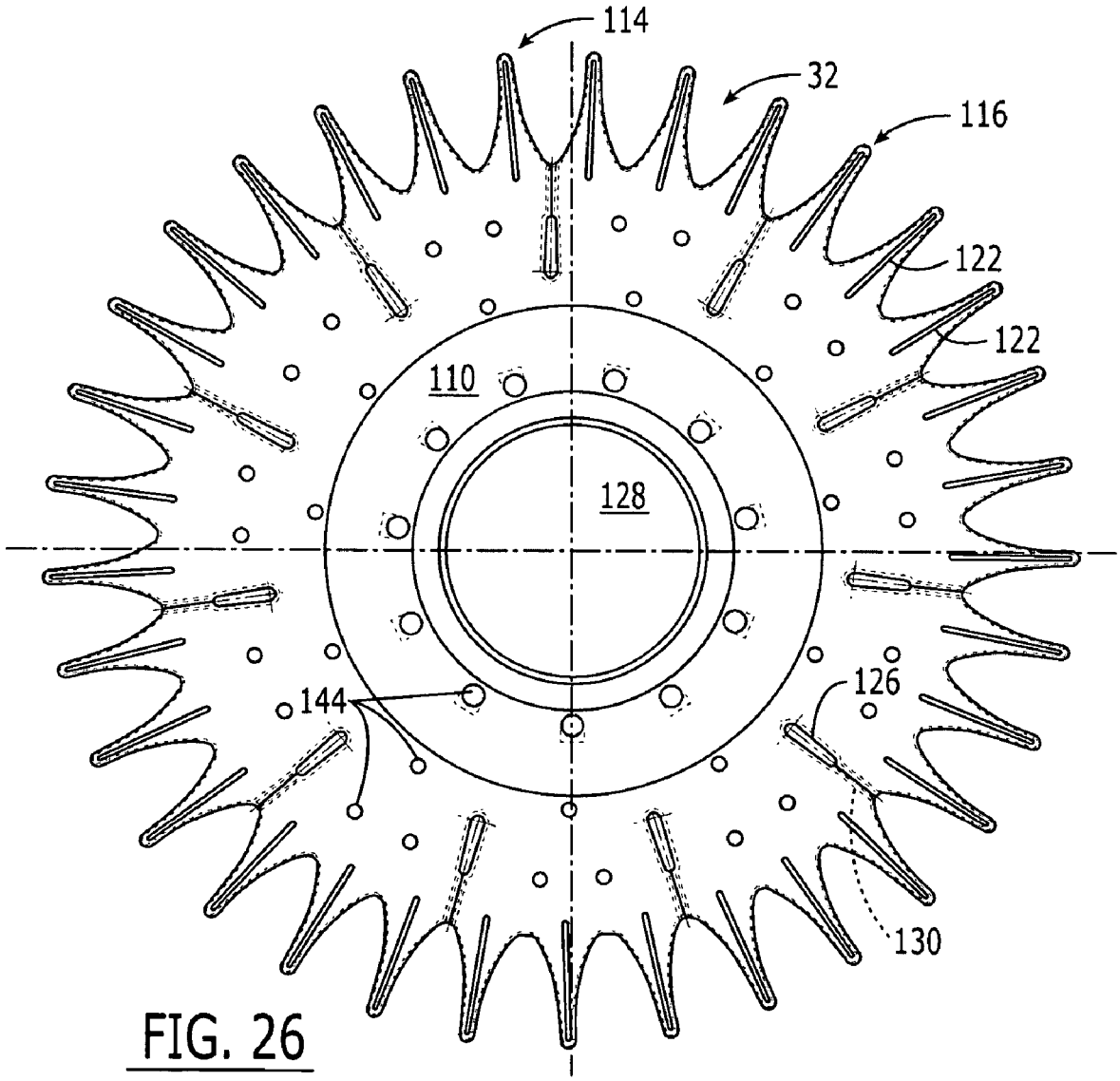
FIG. 26 is a top plan view of an alternate embodiment of a flexible plate.

With reference to FIG. 26, by way of example, the plate 32 may include a plurality of holes 144 extending from the upper surface 110 to the lower surface 112 for modifying a suction provided by the flexible plate during operation of the cleaner 10 with the suction source.

Figure 30:
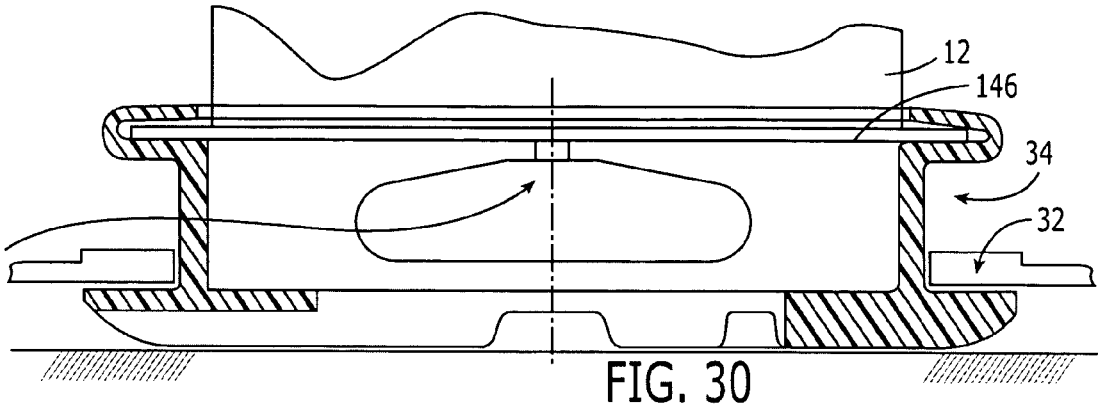
FIG. 30 is an elevation and partial cross section view of a footpad of FIG. 1.
Figure 31:
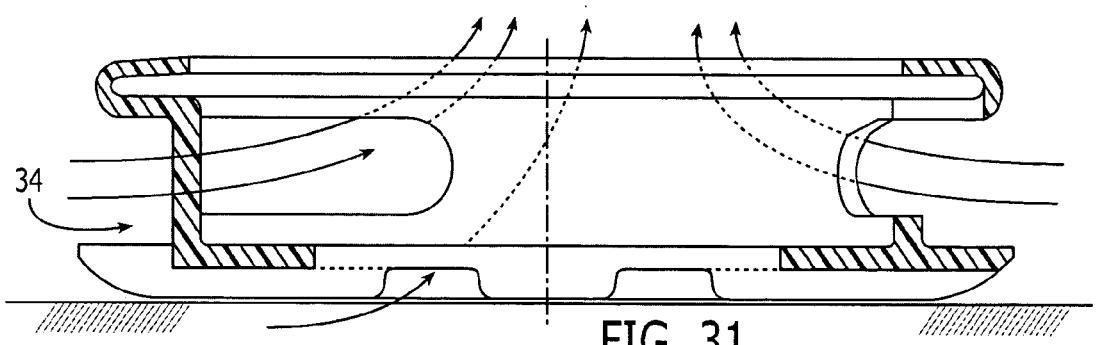
FIG. 31 is a side elevation and partial cross section view of the footpad of FIG. 30 illustrating front and rear lateral inlet ports.
Figure 32:
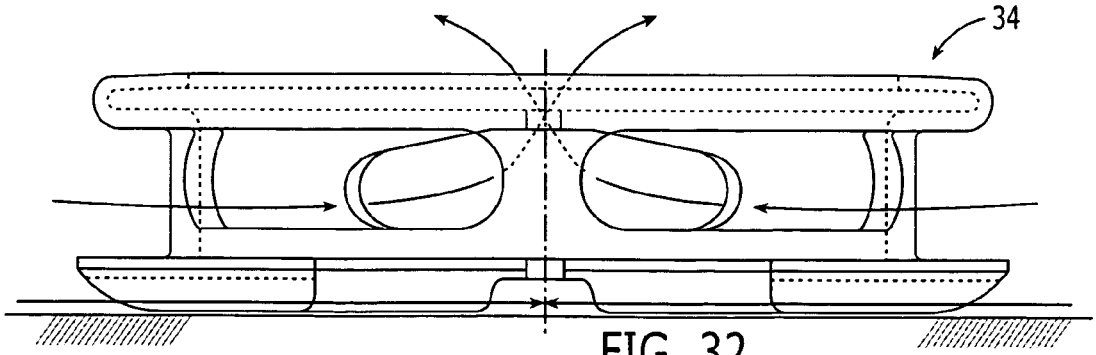
FIG. 32 is an elevation view of the footpad of FIG. 30 illustrating dual lateral inlet ports.

As earlier described with reference to FIGS. 1–3, the cleaner 10 herein described by way of example, includes a foot pad 34 which carries the plate 32. The foot pad 34 is attached to a flange 146 at the inlet 38 of the housing 12 as further illustrated with reference to FIG. 30. The footpad 34 is attached to the housing 12 and the flexible plate 32, and easily replaced by the consumer. As illustrated with reference to FIGS. 31 and 32 using arrows, fluid flow passes through openings within the footpad above the plate and below for providing an effective cleaning of debris from the surface to be cleaned. As illustrated with reference again to FIG. 1–3, a hose connector 148 is carried at the outlet 40 of the housing 12. Under the influence of the vacuum source 48, typically a pump, a flexible hose 150 connected to the connector 148 causes fluid and debris to flow through the housing 12.

As illustrated with reference again to FIGS. 1–3, one embodiment of the hose connector 148 includes a swivel portion 152, nut portion 154 and collar 156 for providing a swivel connection to the hose 150. Such a combination permits easy replacement of parts. A key 158 is carried by the collar 156 to fix the bumper 14 in a forward position.

Various embodiments of the present invention have been herein described in the drawings and specification, by way of example. Although specific terminology was employed, the terms are used in a descriptive sense only and not for purposes of limitation. The invention has been described in detail with specific reference to these illustrated embodiments. However, it will be apparent that various modifications and changes may be made while keeping within the teachings and scope of the invention as described in the foregoing specification and as defined in claims.

That which is claimed is:

1. A flexible plate operable with a submerged swimming pool suction cleaner, the flexible plate comprising:

an upper surface and a longitudinally opposing lower surface defining a thickness dimension therebetween;

a center portion having an aperture extending longitudinally therethrough for connection to a pool cleaner body, a periphery transversely displaced therefrom, and an intermediate portion therebetween, wherein the thickness dimension is generally uniform from the aperture to an outermost edge of the periphery; and wherein the periphery is curved upwardly relative to the intermediate portion when the flexible plate is placed on a generally flat surface to be cleaned, thus having the intermediate portion contacting the surface to be cleaned and the periphery curved upwardly out of contact therewith at the outermost edge thereof; and a reinforcing element formed for reinforcing the upwardly curved periphery, wherein the reinforcing element includes a rib integrally formed with the upper surface and confined within the outermost edge of the periphery so as not to extend outwardly therebeyond.

2. A flexible plate according to claim 1, further comprising a flange extending about the aperture, wherein the flange increases the thickness dimension proximate the aperture.

3. A flexible plate according to claim 1, wherein the periphery includes a plurality of tongues extending thereabout, and wherein each of the plurality of tongues includes the rib.

4. A flexible plate according to claim 3, wherein the plurality of tongues extend radially outward from a center of the flexible plate.

5. A flexible plate according to claim 3, wherein a lower surface portion of the tongues comprises a first portion contacting the surface to be cleaned and a second outermost portion in the upwardly curved periphery.

6. A flexible plate according to claim 3, further comprising a plurality of slots outwardly extending from the intermediate portion.

7. A flexible plate according to claim 6, wherein each of the plurality of slots extends along a first imaginary line centrally positioned between a second imaginary line passing centrally through each of the plurality of tongues.

8. A flexible plate according to claim 1, further comprising a plurality of slots outwardly extending from the intermediate portion.

9. A flexible plate according to claim 8, further comprising a plurality of slits and wherein each one of the plurality of slits extends from each one of the plurality of slots outwardly through the periphery.

10. A flexible plate according to claim 8, wherein each of the plurality of slots extends through the periphery.

11. A flexible plate according to claim 8, wherein each of the plurality of slots is tapered.

12. A flexible plate according to claim 8, wherein each of the plurality of slots is tapered and provides a diminishing separation between walls forming the slot as the slot extends radially outward from the center and approaches the periphery.

13. A flexible plate according to claim 1, wherein the lower surface comprises a plurality of grooves therein extending outwardly from proximate the center portion.

14. A flexible plate according to claim 13, wherein at least a portion of the plurality of grooves extends into the center portion and the periphery of the plate.

15. A flexible plate according to claim 1, further comprising a plurality of pleats extending from the center portion, each pleat forming a groove within the lower surface and a protrusion within the upper surface.

16. A flexible plate according to claim 15, wherein the plate comprises a plurality of holes extending from the upper surface to the lower surface for modifying a suction provided by the flexible plate during operation of the apparatus with a suction source.

17. A flexible plate operable with a submerged swimming pool suction cleaner, the flexible plate comprising:

an upper surface and a longitudinally opposing lower surface defining a thickness dimension therebetween;

a center portion having an aperture extending longitudinally therethrough for connection to a pool cleaner body, a periphery transversely displaced therefrom, and an intermediate portion therebetween, wherein the thickness dimension is generally uniform from the aperture to an outermost edge of the periphery, wherein the periphery is curved upwardly relative to the intermediate portion when the flexible plate is placed on a generally flat surface to be cleaned, thus having the intermediate portion contacting the surface to be cleaned and the periphery curved upwardly out of contact therewith at the outermost edge thereof;

a reinforcing element integrally formed with the upper surface for reinforcing the upwardly curved periphery, wherein the reinforcing element includes a rib confined within the outermost edge of the periphery so as not to extend outwardly therebeyond; and a plurality of slots outwardly extending from the intermediate portion, wherein the lower surface comprises a plurality of grooves therein extending outwardly from proximate the center portion.

18. A flexible plate operable with a submerged swimming pool suction cleaner, the flexible plate comprising:

an upper surface and a longitudinally opposing lower surface defining a thickness dimension therebetween;

a center portion having an aperture extending longitudinally therethrough for connection to a pool cleaner body, a periphery transversely displaced therefrom, and an intermediate portion therebetween, wherein the thickness dimension is generally uniform from the aperture to an outermost edge of the periphery, wherein the periphery is curved upwardly relative to the intermediate portion when the flexible plate is placed on a generally flat surface to be cleaned, thus having the intermediate portion contacting the surface to be cleaned and the periphery curved upwardly out of contact therewith at the outermost edge thereof;

a reinforcing element integrally formed with the upper surface for reinforcing the upwardly curved periphery, wherein the reinforcing element includes a rib confined within the outermost edge of the periphery so as not to extend outwardly therebeyond;

a plurality of slots outwardly extending from the intermediate portion; and a plurality of pleats extending from the center portion, each pleat forming a groove within the lower surface and a protrusion within the upper surface.

* * * * *